US006304843B1

(12) United States Patent
Choi et al.

(10) Patent No.: US 6,304,843 B1
(45) Date of Patent: Oct. 16, 2001

(54) METHOD AND APPARATUS FOR RECONSTRUCTING A LINEAR PREDICTION FILTER EXCITATION SIGNAL

(75) Inventors: Hung-Bun Choi, New Territories; Harvey Hau-Fai Wong, Laguna; Wing Tak Kenneth Wong, North Point, all of (HK)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/226,914

(22) Filed: Jan. 5, 1999

(51) Int. Cl.[7] ..... G10L 19/04

(52) U.S. Cl. ..... 704/219; 704/220; 704/205; 704/217; 704/258

(58) Field of Search ..... 704/219, 216, 704/217, 205, 218, 220, 258, 263, 262, 264, 268, 206, 208

(56) References Cited

U.S. PATENT DOCUMENTS

| | | | | |
|---|---|---|---|---|
| 5,293,448 | * | 3/1994 | Honda | 704/208 |
| 5,517,595 | * | 5/1996 | Kleijn | 704/205 |
| 5,754,974 | * | 5/1998 | Griffin et al. | 704/206 |
| 5,774,837 | * | 6/1998 | Yeldener et al. | 704/208 |
| 5,809,456 | * | 9/1998 | Cucchi et al. | 704/217 |
| 5,845,244 | * | 12/1998 | Proust | 704/220 |
| 6,041,297 | * | 3/2000 | Goldberg | 704/219 |
| 6,067,511 | * | 5/2000 | Grabb et al. | 704/223 |
| 6,070,137 | * | 5/2000 | Bloebaum et al. | 704/227 |
| 6,119,082 | * | 9/2000 | Zinser et al. | 704/223 |

* cited by examiner

*Primary Examiner*—William Korzuch
*Assistant Examiner*—Vijay B Chawan

(57) ABSTRACT

An apparatus and method of reconstructing a linear prediction synthesis filter excitation signal, by: receiving a signal representative of output from a linear prediction synthesis filter, producing therefrom a deterministic signal comprising a magnitude spectrum (50) and a phase spectrum (52); and producing (54) the reconstructed excitation signal from the deterministic signal and a noise signal.

6 Claims, 2 Drawing Sheets

METHOD AND APPARATUS FOR RECONSTRUCTING A LINEAR PREDICTION FILTER EXCITATION SIGNAL

FIELD OF THE INVENTION

This invention relates to a method and apparatus for reconstructing a linear prediction filter excitation signal. Such signal reconstruction is commonly employed in speech coding algorithms where a speech signal is decomposed to a spectral envelope and a residual signal for efficient transmission.

BACKGROUND OF THE INVENTION

The demand for very low bit-rate speech coders (2.4 kb/s and below) has increased significantly in recent years. Applications for these coders include mobile telephony, internet telephony, automatic answering machines and military communication systems as well as voice paging networks. Many speech coding algorithms have been developed for these applications. These algorithms include: Mixed Excitation Linear Prediction Coding (MELP), Prototype Waveform Interpolation Coding (PWI), Sinusoidal Transform Coding (STC) and Multiband Excitation Coding (MBE). In all of these algorithms, only the magnitude information of an LP filter residual signal or a speech signal is transmitted. In use of these algorithms, the phase information is recovered at the decoder by modeling, or simply omitted.

However, omitting phase information in this way results in a synthetic and "buzzing" quality in the decoded speech. Although phase information may be derived from the encoded magnitude spectrum using Sinusoidal Transform Coding, synthetic and "buzzing" qualities still exist in the decoded speech owing to minimum phase assumptions in the speech production model. Improved speech quality has been reported when the phase spectra of some pre-stored waveforms are used, but only a little information from the pre-stored waveforms is revealed using this technique.

It is an object of this invention to provide a method and apparatus for reconstructing a linear prediction systhesis filter excitation signal, for use in speech processing, wherein the above mentioned disadvantages may be alleviated.

BRIEF SUMMARY OF THE INVENTION

In accordance with a first aspect of the present invention there is provided an apparatus for reconstructing a linear prediction filter excitation signal.

In accordance with a second aspect of the present invention there is provided a method of reconstructing a linear prediction filter excitation signal.

BRIEF DESCRIPTION OF THE DRAWINGS

Two embodiments of the invention will now be more fully described, by way of example only, with reference to the accompanying drawings, in which.

DETAILED DESCRIPTION OF THE DRAWINGS

Figure 1:
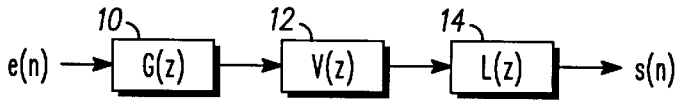
FIG. 1 shows a block diagram illustration of a simple voiced speech production model.

A simple voiced speech production model is typically expressed in terms of three cascaded filters excited by a pseudo-periodic series of discrete time impulses e(n), as illustrated in FIG. 1. These filters are:

i) a glottal filter (10), G(z), ii) a vocal tract filter (12), V(z), and iii) a lip-radiation filter (14), L(z).

The transfer function of the voiced speech production model is defined as:

$$S(z)=G(z)V(z)L(z) \tag{1}$$

G(z) is a glottal excitation filter which is used to provide an excitation signal to the vocal tract. The transfer function of G(z) is defined as:

$$G(z) = \frac{1}{(1-\beta z^{-1})^2} \tag{2}$$

where values of β are the poles of G(z).

V(z) is used to model the K vocal tract resonances (or formants) which is assumed to be an all-pole model and has a transfer function:

$$V(z) = \frac{1}{\prod_{i=1}^{K} (1-\rho_i z^{-1})(1-\bar{\rho}_i z^{-1})} \tag{3}$$

where values of $\rho_i$ are the poles of V(z). The frequency and bandwidth of a formant is directly related to the location of the pole within the unit circle as shown in FIG. 2.

Figure 2A:
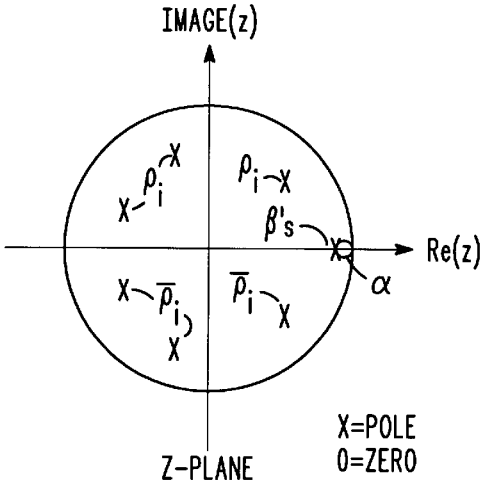
FIGS. 2*a* and 2*b* show Z-plane diagrams of transfer functions of respectively the simplified voiced speech production model of FIG. 1 and its associated LP residual signal.

L(z) is used to model the lip-radiation and is considered to be a differentiator which has a single positive zero on the real axis. L(z) is defined as:

$$L(z)=1-\alpha_z^{-1} \tag{4}$$

where α takes a value close to unity. The system function of the simple voice speech production model can be expressed in the Z-plane as illustrated in FIG. 2*a*.

Figure 3:
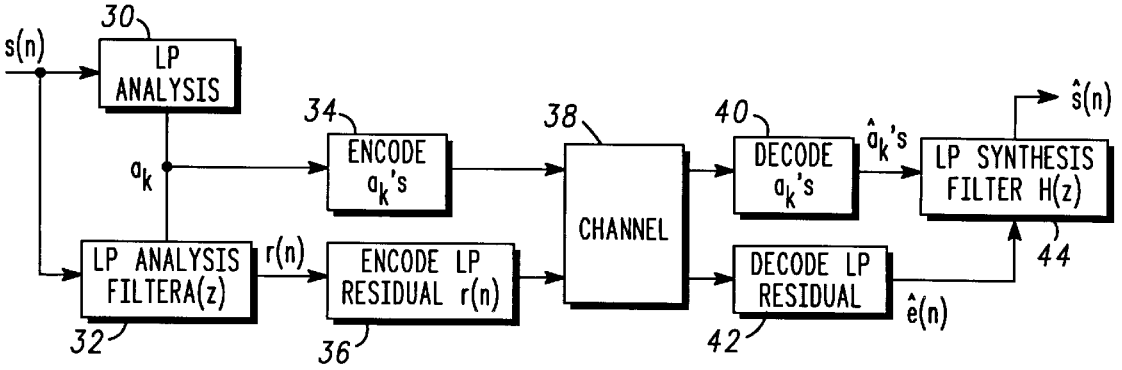
FIG. 3 shows a block diagram illustration of an LP based speech coder.

In FIG. 3 the schematic diagram of a linear predictive (LP) based speech coder is shown. At the encoder, LP analysis (30) is used to estimate the spectral envelope of a segment of speech signal, and thus to yield a set of filter coefficients $a_k$. The set of $a_k$'s is used in an LP analysis filter (32) to process the speech segment to yield an LP residual signal r(n). The LP residual, together with the set of filter coefficients, are encoded (34, 36) and transmitted over the channel (38). At the decoder, the two signals $\hat{a}_k$ and ê(n) are re-covered (40, 42). The residual signal ê(n) is used as an excitation to an LP synthesis filter (44), and hence to obtain the synthesized speech ^S(n).

Figure 2B:
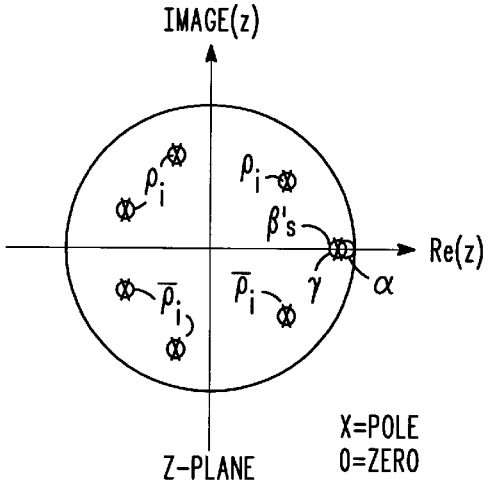

The function of LP analysis is to estimate the spectral envelope of the speech segment. It can be seen from FIG. 2*a* that this is equivalent to estimating the location of the poles inside the unit circle. It is often assumed that the magnitude effect of one of the glottal excitation poles β's is cancelled out with the lip-radiation zero α. Hence LP analysis only estimates the locations of $\rho_i$'s and one of the β's. By passing through the speech segment to an LP analysis filter A(z), the magnitude spectrum of the speech segment is flattened. This is effectively the same as putting the zero's on the locations of the poles. As a result, the LP residual signal should have a flat magnitude spectrum and zero phase, as shown in FIG. 2*b*.

Figure 4A:
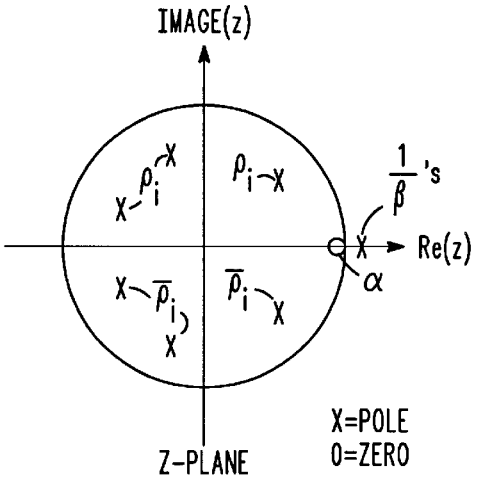
FIGS. 4*a* and 4*b* show Z-plane diagrams of transfer functions of respectively a modified voiced speech production model incorporating the present invention and its associated LP residual signal.

Recent research results suggest that a glottal excitation filter which models better the true glottal excitation should have poles outside the unit circle. Thus, to incorporate this suggestion, the system function in FIG. 2*a* is modified, as shown in FIG. 4*a*. The transfer function of the modified voiced speech production model is defined as:

$$S(z) = \frac{(1-\alpha z^{-1})}{\left(1-\frac{1}{\beta}z^{-1}\right)^2 \prod_{i=1}^{K}(1-\rho_i z^{-1})(1-\bar{\rho}_i z^{-1})} \tag{5}$$

Figure 4B:
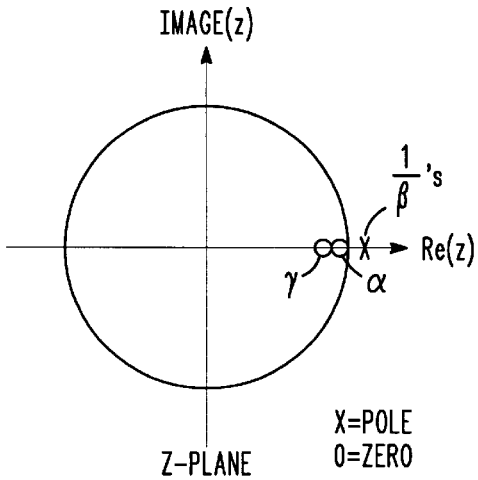

If LP analysis is applied to a segment of speech signal and LP filtering the speech segment, the LP residual will have a system function as illustrated in FIG. 4*b*. The system function in FIG. 4*b* can be implemented by a digital filter E(z) which has a transfer function defined as:

$$E(z) = \frac{(1-\alpha z^{-1})(1-\gamma z^{-1})}{\left(1-\frac{1}{\beta}z^{-1}\right)^2} \tag{6}$$

Although it may be noted that E(z) is an unstable system, this is not relevant since we are only interested in the phase response of the filter.

Figure 5:
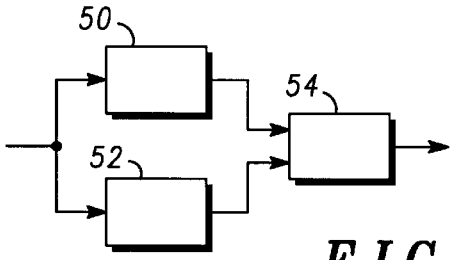
FIG. 5 shows a block diagram illustration of a voiced speech decoder incorporating the present invention.

Using the above information, an LP excitation is regenerated or reconstructed at the decoder using a flat magnitude and a derived phase spectrum, as shown in FIG. 5. In the decoder of FIG. 5, a magnitude deriver (50) and a phase deriver (52) are used to compute the required magnitude and phase spectra from received parameters. The derived magnitude and phase signals are applied to an LP synthesis filter (54) to generate the reconstructed speech signal.

The phase spectrum is computed as:

$$\phi_E(\omega) = -\tan^{-1}\left(\frac{\alpha\sin\omega}{1.0-\alpha\cos\omega}\right) - \tan^{-1}\left(\frac{\gamma\sin\omega}{1.0-\gamma\cos\omega}\right) + 2\tan^{-1}\left(\frac{\sin\omega}{\beta-\cos\omega}\right) \tag{7}$$

It will be understood that the magnitude spectrum of the LP excitation signal may be derived using the same argument or simply using the original magnitude spectrum of the LP residual. It will be appreciated that computational simplicity and bit-rate efficiency is gained by using a flat magnitude spectrum.

In implementing this scheme, values must be chosen for the coefficients α, β and γ of equation (7).

The value of α can be kept constant, as:

$$\alpha=1 \tag{8}$$

Alternatively, depending on the particular implementation and bit rate requirement, the value of α can be varied in the range of, say, 0.9 to 1.

For the value of γ, reference is drawn to FIG. 4*b*. From FIG. 4*b* it can be seen that γ is a zero which lies on the real axis, and hence it contributes as a spectral tilt on the spectral envelope. Suppose a set of LP filter coefficients is available at the decoder and these filter coefficient characterize the spectral envelope of an LP synthesis filter H(z). The spectral tilting may be computed from the first PARCOR $k_1$ as:

$$\gamma=|k_1| \tag{9}$$

The value of $k_1$ is calculated as:

$$k_1 = -\frac{A(1)}{A(0)} \tag{10}$$

where A(i) is the $i^{th}$ autocorrelation function of h(n) and is defined as:

$$A(i) = \sum_{n=0}^{N-1} h(n)h(n-i)$$

and h(n) is the impulse response of the LP synthesis filter.

A good approximation for the value of β may be calculated as $$\beta = \frac{\alpha+\gamma}{2} \tag{11}$$

A computationally simpler way of deriving the approximate phase spectrum is achieved by assuming:

$$\alpha\approx\beta\approx\gamma \tag{12}$$

Hence, the phase spectrum is calculated as:

$$\phi_E(\omega) = -2\tan^{-1}\left(\frac{\gamma\sin\omega}{1.0-\gamma\cos\omega}\right) + 2\tan^{-1}\left(\frac{\sin\omega}{\gamma-\cos\omega}\right) \tag{13}$$

Experimental results have shown that the speech signal synthesized using only the deterministic signal is noticably synthetic. This is due to the fact that a voiced speech signal is a quasi-periodic signal in which random components exist. To model the randomness characteristics, the transfer function of the voice speech production is modified as:

$$S(\omega) = \begin{cases} G(\omega)V(\omega)L(\omega) & 0<\omega\le\omega_s \\ N(\omega)V(\omega)L(\omega) & \omega_s<\omega\le\pi \end{cases} \tag{14}$$

where:

S(ω) is the frequency response of the speech signal,

G(ω) is the frequency response of the glottal excitation filter,

V(ω) is the frequency response of the vocal tract filter,

L(ω) is the frequency response of the lip radiation filter,

N(ω) is the frequency response of a filter whose impulse response is a white Gaussian noise signal, and $\omega_s$ is the frequency separating the two signal types.

Equation (14) suggests that the vocal tract filter V(ω) and the lip-radiation filter L(ω) are now excited by a combined source, G(ω) and N(ω). The combined excitation signal is composed of a glottal excitation for the lower frequency band and a noisy signal for the higher frequency band.

At the decoder, the speech signal is recovered using the following equation, where the synthesized speech is produced by driving a combined LP excitation through an LP synthesis filter H(ω). The combined excitation is generated using a magnitude spectrum together with a derived phase spectrum for lower frequency band and a random phase spectrum for higher frequency band.

$$\hat{S}(\omega) = \begin{cases} E(\omega)H(\omega) & 0 < \omega \le \omega_s \\ N(\omega)H(\omega) & \omega_s < \omega \le \pi \end{cases} \quad (15)$$

Figure 6:
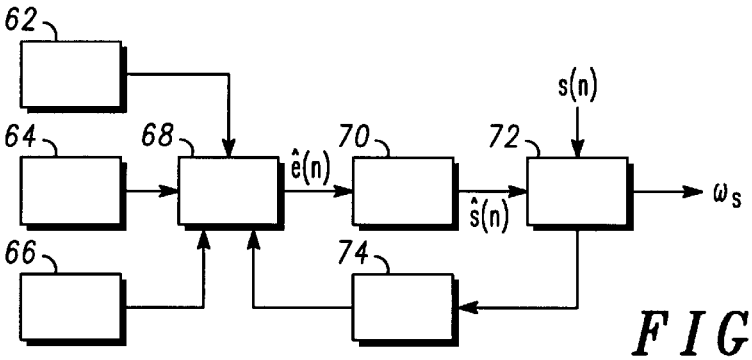
FIG. 6 shows a block diagram illustration of an "analysis-by synthesis" method of separation frequency determination which may be used in the present invention.

The separation frequency $\omega_s$ may be determined at the encoder via an "analysis-by-synthesis" approach. This manner of determining the value of $\omega_s$ is shown in FIG. 6. Prior to the generation of the combined excitation, a magnitude spectrum (62), a derived phase spectrum (64) and a full-band random phase spectrum (66) are determined. The three spectra are used to generate (68) a combined excitation signal ê(n) for a value of $\omega_s$. The combined excitation signal is used to excite H(z) (70) to yield a synthesized speech signal ˆs(n). The synthesized speech is then compared (72) with the original s(n) using a similarity measure. The similarity measure is defined as the cross-correlation between the two speech signals C(s,ŝ). This process is carried out for a range of values of $\omega_s$ (74). The value of $\omega_s$ which yields the highest similarity measure will be encoded and sent to the decoder. At the decoder, an identical copy of the three spectra is available and the re-generation process is exactly the same as at the encoder.

Figure 7:
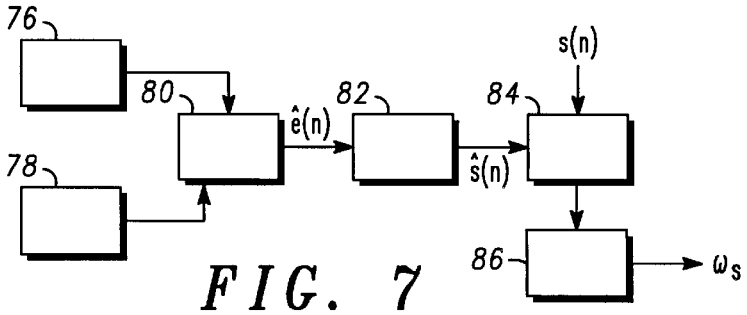
FIG. 7 shows a block diagram illustration of an "open-loop" method of separation frequency determination which may be used in the present invention.

Experimental results show that the value of $\omega_s$ may alternatively be estimated by using an open-loop approach, as shown in FIG. 7. In this method, a deterministic signal is generated (80) at the encoder using a magnitude spectrum (76) and a derived phase spectrum (78). The deterministic signal is then passed through an LP synthesis filter (82) to yield a synthesized speech signal. The synthesized speech signal is compared (84) with the original using a similarity measure C(s,ŝ). The more the synthesised speech is like the original, the higher will be the value of $\omega_s$, i.e. glottal excitation dominates, and vice versa. The value of $\omega_s$ is encoded at the encoder (86), quantised and sent over the channel. The value of the $\omega_s$ is calculated at the encoder as:

$$\omega_s = C(s,\hat{s})^* \pi \quad (16)$$

Using the open-loop method, the computational complexity of the encoder can be reduced with only a minor degradation in the speech quality.

It will be appreciated that other variations and modifications will be apparent to a person of ordinary skill in the art.

What is claimed is:

1. An apparatus for reconstructing a linear prediction synthesis filter excitation signal, the apparatus comprising:

means for receiving parameters representative of a signal's magnitude and phase spectrum, and for producing therefrom a deterministic signal comprising a magnitude spectrum and a phase spectrum; and means for receiving the deterministic signal and a noise signal and for reconstructing therefrom the linear prediction synthesis filter excitation signal, wherein the phase spectrum is derived substantially from the formula:

$$\phi E(\omega) = -\tan^{-1}\left(\frac{\alpha \sin \omega}{1-\alpha \cos \omega}\right) - \tan^{-1}\left(\frac{\gamma \sin \omega}{1-\gamma \cos \omega}\right) + 2\tan^{-1}\left(\frac{\sin \omega}{\beta - \cos \omega}\right)$$

where $\phi E(\omega)$ represents the phase at frequency ω,

α is a predetermined constant,

γ represents a desired degree of spectral tilting, and

β is substantially equal to the mean average of α and γ.

2. An apparatus as claimed in claim 1 wherein the magnitude spectrum is substantially flat.

3. An apparatus as claimed in claim 1 wherein the value of γ is substantially equal to |−A(1)/A(0)|, where A(i) is the $i^{th}$ autocorrelation function of the impulse response of the linear prediction synthesis filter.

4. An apparatus as claimed in claim 1 wherein the values of α, β and γ are substantially equal.

5. An apparatus as claimed in claim 1 wherein the value of α is substantially equal to unity.

6. A method for reconstructing a linear prediction synthesis filter excitation signal, the method comprising the steps of:

receiving parameters representative of a signal's magnitude and phase spectrum, and producing therefrom a deterministic signal including a magnitude spectrum and a phase spectrum; and receiving the deterministic signal and a noise signal and reconstructing therefrom the linear prediction synthesis filter excitation signal, wherein the phase spectrum is derived substantially from the formula:

$$\phi E(\omega) = -\tan^{-1}\left(\frac{\alpha \sin \omega}{1-\alpha \cos \omega}\right) - \tan^{-1}\left(\frac{\gamma \sin \omega}{1-\gamma \cos \omega}\right) + 2\tan^{-1}\left(\frac{\sin \omega}{\beta - \cos \omega}\right)$$

where $\phi E(\omega)$ represents the phase at frequency ω,

α is a predetermined constant,

γ represents a desired degree of spectral tilting, and

β is substantially equal to the mean average of α and γ.

* * * * *